US006416092B1

(12) United States Patent
Rathmann

(10) Patent No.: US 6,416,092 B1
(45) Date of Patent: Jul. 9, 2002

(54) HANDLE ARRANGEMENT FOR A MOVABLE BODY PART

(75) Inventor: Klaus Rathmann, Frankfurt (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/390,531

(22) Filed: Sep. 3, 1999

(30) Foreign Application Priority Data

Sep. 12, 1998 (DE) ..... 198 41 729

(51) Int. Cl.[7] ..... E05B 3/00

(52) U.S. Cl. ..... 292/336.3; 292/DIG. 37; 200/50.1

(58) Field of Search ..... 292/201, 216, 292/336.3, 347, DIG. 37; 70/255, 257, DIG. 30; 200/43.22, 50.02, 50.1, 50.12

(56) References Cited

U.S. PATENT DOCUMENTS

| | | | | |
|---|---|---|---|---|
| 3,204,807 A | | 9/1965 | Ramsing | |
| 4,185,178 A | | 1/1980 | Drees | |
| 4,280,633 A | * | 7/1981 | Boros | 220/241 |
| 4,762,348 A | * | 8/1988 | Matsumoto | 292/201 |
| 4,778,206 A | * | 10/1988 | Matsumoto | 292/201 |
| 5,560,659 A | * | 10/1996 | Dault | 292/336.3 |
| 5,613,716 A | * | 3/1997 | Cafferty | 292/216 |
| 5,713,613 A | * | 2/1998 | Honma | 292/201 |
| 5,775,456 A | * | 7/1998 | Reppas | 180/322 |
| 5,844,470 A | * | 12/1998 | Garnault | 340/426 |
| 5,901,991 A | * | 5/1999 | Hugel | 292/201 |
| 5,904,385 A | * | 5/1999 | Linder | 292/336.3 |

FOREIGN PATENT DOCUMENTS

| | | |
|---|---|---|
| CH | 195169 | 4/1938 |
| DE | 3835265 | 4/1990 |
| DE | 4311786 | 10/1994 |
| DE | 9415257 | 11/1994 |
| DE | 19547724 | 6/1997 |

* cited by examiner

*Primary Examiner*—Gary Estremsky
(74) *Attorney, Agent, or Firm*—Martin A. Farber

(57) ABSTRACT

A handle arrangement for a movable body part, such as a door or the like of a vehicle, having a handle recess, a pivoted part, which is linked in the region of the handle recess, closes the latter by spring force and is to be opened manually, and an actuating element arranged in the handle recess and intended for a locking device. The actuating element is an electric switching element which lies in an electric circuit with a power supply unit and an actuator, the actuator being provided for the actuation of a lock element of the locking device.

6 Claims, 2 Drawing Sheets

HANDLE ARRANGEMENT FOR A MOVABLE BODY PART

FIELD AND BACKGROUND OF THE INVENTION

The invention relates to a handle arrangement for a movable body part, such as a door of a vehicle.

DE 38 35 265 A1 discloses such a handle arrangement. In this handle arrangement, there is a handle recess in the movable body part, and this handle recess is concealed or made accessible by a pivoted part. The pivoted part in DE 38 35 265 A1 is intended to protect an actuating element, arranged in the handle recess, for a lock from contaminants during travel; on the other hand, however, it is intended to clear the handle recess when the vehicle is stopped so that the movable body part can be moved, in particular opened, by an operator of the vehicle by reaching into this handle recess. For this purpose, there is an actuating device in the form of an actuating cylinder, the actuating cylinder, when the vehicle is stopped, bringing the pivoted part into such a position in which the handle recess is cleared and, when the vehicle is traveling, pivoting the pivoted part into such a position in which the handle recess is covered. The actuating cylinder is actuated as a function of a speed signal of the vehicle. Further details concerning the actuating element for the lock or concerning the lock itself are not given in DE 38 35 265 A1.

SUMMARY OF THE INVENTION

The object of the invention is therefore to develop a handle arrangement described at the beginning with regard to comfort and safety aspects.

According to the invention, provision is made for the actuating element to be an electric switching element which lies in an electric circuit with a power supply unit and an actuator, the actuator being designed for the actuation of a lock element of the locking device. Due to the fact that the electric switching element, which is arranged in the handle recess, is covered by the pivoted part, this electric switching element cannot be manually actuated immediately and also cannot be actuated inadvertently, which is of particular importance in the case of an electric locking device, since the actuation of the electric switching element immediately leads to activation of the actuator, which in turn actuates a lock element of the locking device. If the actuator is designed, for example, for actuating a pawl, which after actuation releases a rotary catch, the movable body part, such as a door of the vehicle for example, is immediately brought into the open position by means of the release of the rotary catch. Here, it is of advantage that the electric switching element is not accessible until after the pivoting of the pivoted part, so that this electric switching element cannot be actuated unintentionally. The comfort aspect is ensured by the use of an actuator, since the electric switching element is actuated only with small forces, if need be only has to be touched, in order to bring the movable body part from its closed position into the open position. The avoidance of contaminants in the electric switching element is of no importance at all or is only of secondary importance at this point, since this electric switching element may be designed to be protected from environmental effects such as contamination. It is essential here that the locking device can only be actuated after actuation of at least two separate operating points (first operating point: pivoted part, second operating point: electric switching element). That is to say that the electric switching element can only be reached when the pivoted part has been brought quite deliberately from its closed position into the open position against the spring force.

In a development of the invention, a sensor is provided on the pivoted part in order to detect a movement of and/or the position of the pivoted part, in which case the actuator can be activated or deactivated depending on the detected movement and/or the position of the pivoted part. In this case, the actuation of one of the two operating points is shifted to the electrical level, so that the actuator is switched on only when the sensor has detected that the pivoted part has been brought out of its closed position into the open position and the electric switching element has been manually operated by the operator of the vehicle. This may be realized, for example, by virtue of the fact that the electric switching element and a further switching element, which is actuated as a function of the output signal of the sensor, lie in series in the electric circuit, and the electric circuit is closed and the actuator activated only upon activation of both switching elements. This may be realized, for example by means of a control unit, to which the actuation of the electric switching element, as input signal, and the output signal of the sensor are fed. Depending on the admissibility (justification) of a desire to perform an opening action, the control unit activates the actuator if there is the justification to do so and prevents it if there is no justification.

In a development of the invention, the electric switching element is a pushbutton, which is of simple construction, is simple to operate and can also be arranged in an uncomplicated manner in the handle recess and be electrically interconnected.

The pushbutton part accessible to the operator of the vehicle may be provided with a protective cover, which protects this part from contaminants such as dust and moisture.

In a development of the invention, the actuator is provided as an opening aid. The opening aid is explained using the example of a door of the vehicle. The door is in the closed state. If occupants now want to open the door from the interior space of the vehicle, a grip, such as a door interior handle for example, is actuated, this actuation being converted into an electrical signal and an actuator being activated by means of this electrical signal, this actuator actuating at least one lock element, such as, for example, a pawl interacting with a rotary catch, so that the door immediately springs open with actuation of the grip. For this normal case, a mechanical connection from the grip to this lock element via connecting elements is not necessary, so that comfortable opening of the door is possible without expenditure of force during the unlocking. At this point, it is especially important that the grip cannot be actuated inadvertently, since this immediately leads to the opening of the door. Therefore the pivoted part according to the invention must first be moved out of its closed position into its open position in order to gain access to the electric switching element, and only then does the actuation of the latter activate the actuator. Provision is therefore made in a development of the invention for the handle arrangement according to the invention to be arranged on the inside of the body part, that is in the direction of the interior space of the vehicle. The handle arrangement may of course also be arranged on the outside of the body part, although this is not so important, since the exterior grip (door exterior handle) is generally only actuated when the vehicle is stationary.

BRIEF DESCRIPTION OF THE DRAWING

An exemplary embodiment of the handle arrangement according to the invention is explained below and described with reference to the figures, wherein FIGS. 1 and 2 schematically show a locking device according to the invention.

DETAILED DESCRIPTION OF THE PREFERRED EMBODIMENT

Figure 1:
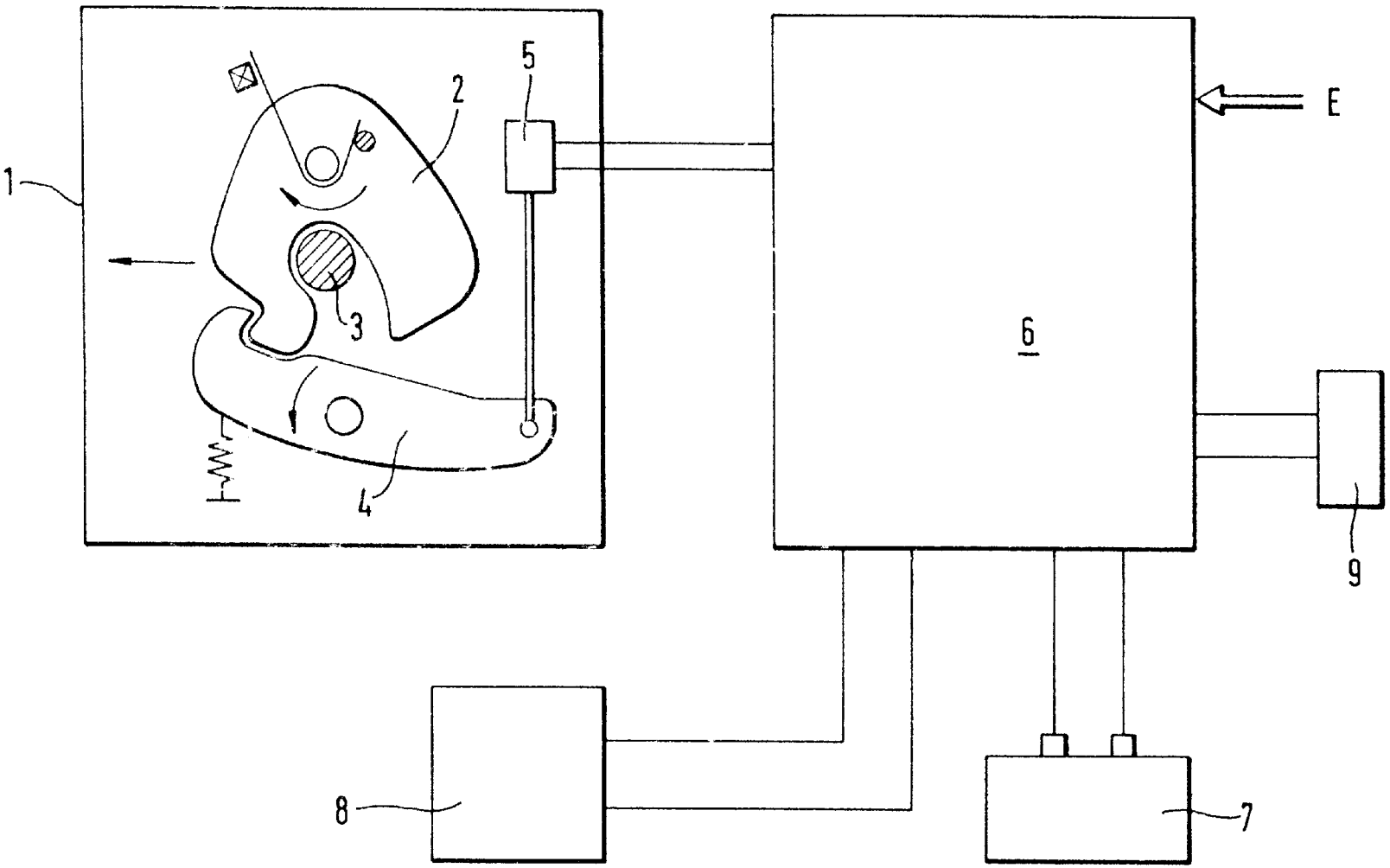

FIG. 1 schematically shows a locking device 1, which is arranged in an independent housing (not designated in more detail) or on a so-called lock plate. The locking device 1 comprises a rotary catch 2, which in the position shown in FIG. 1 encloses a locking bolt 3, so that the door, the tailgate, the trunk lid or the like of the vehicle is thus held in its locked position. The rotary catch 2 in turn is arrested by a pawl 4, in which case the pawl is spring-loaded by means of a spring and an actuator 5 works against this spring force in order to move the pawl 4 about its pivot, so that the rotary catch 2 (with or without preliminary detent) is released. After this release, the locking bolt 3, which is arranged on the door, can be moved out of the legs of the rotary catch 2, so that the door can be opened. In addition, an opposite arrangement is also conceivable, in which the locking bolt 3 is arranged on the body and the locking device 1 is arranged in the door.

The actuator 5 is constructed, for example, as an electric motor (in particular geared-down), as an electromagnet with a plunger acting on the pawl 4, or the like. In addition, such actuators which produce an actuating force for the pawl 4 electrically are also conceivable. In this respect, electrohydraulic or electropneumatic actuators, for example, may be mentioned.

The actuator 5 is electrically interconnected with a control device 6, as shown in FIG. 1.

The control device 6 is supplied with power from a vehicle battery 7 (power supply unit) in order to be able to operate the actuator 5.

Designated by reference numeral 8 is an electric switching element, in particular a pushbutton, which is attached to the control device 6. The actuator 5 is not activated by the control device 6 and cannot actuate the pawl 4 until the pivoted part has 4 been moved out of its closed position into the open position and the electric switching element 8 has been actuated. Furthermore, the control device 6 is also interconnected with a sensor 9, which is provided on the pivoted part 10 in order to detect a movement of and/or the position of the pivoted part 10, in which case the actuator can be activated or deactivated depending on the detected movement and/or the position of the pivoted part 10. The electric switching element 8 and if need be the sensor 9 are arranged in an electric circuit, so that the actuator 5 is not switched on until after actuation of the electric switching element 8 and if need be after detection of an actuation of the pivoted part 10 by means of the sensor 9. Instead, it is also possible for only the actuation of the electric switching element 8 (for example the pushbutton) and of the sensor 9 to be detected, in which case, as a function of this, switches in the electric circuit (such as, for example, relays, transistors or the like) are actuated in order to switch the actuator on or off.

Figure 2:
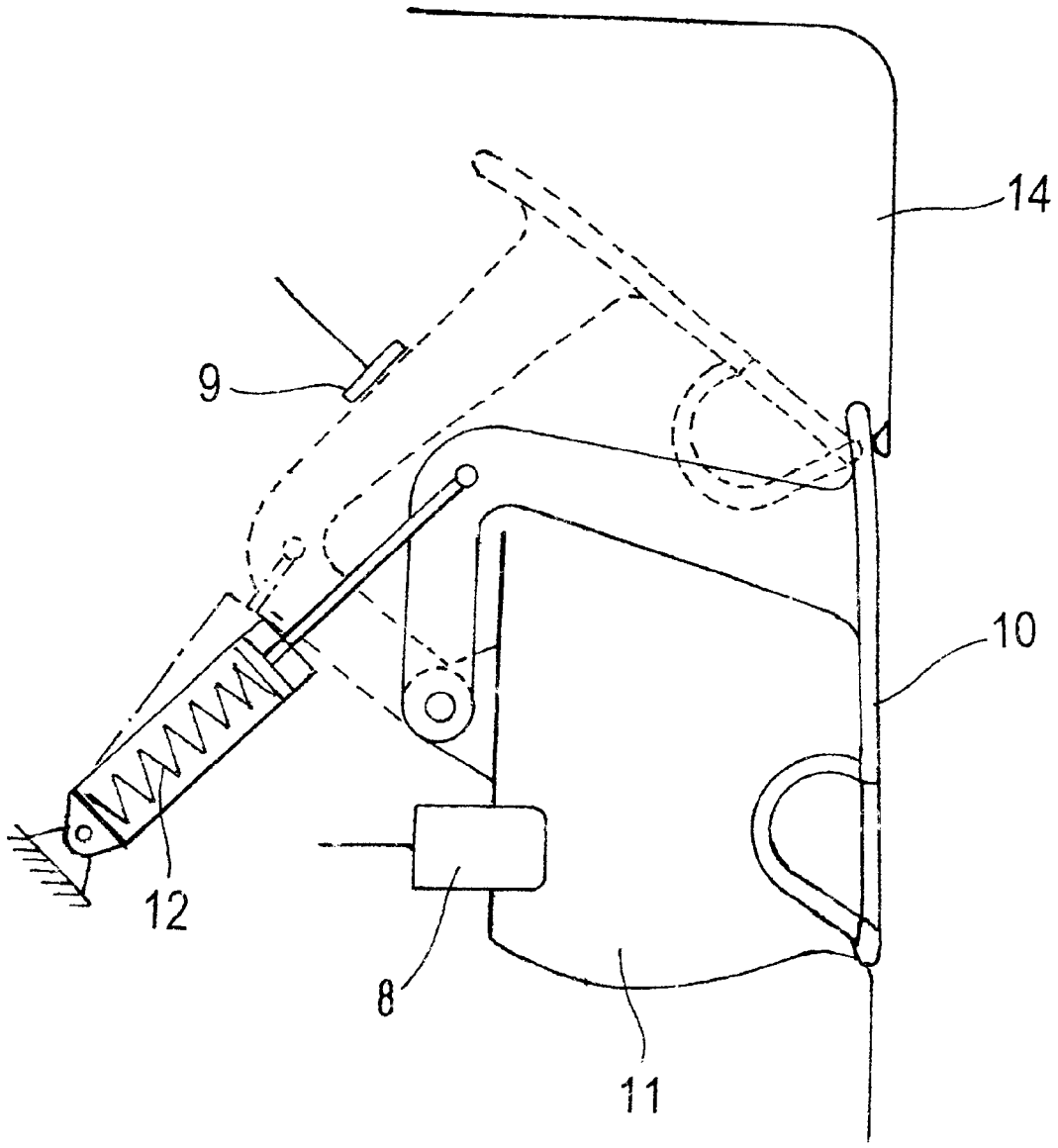

With respect to FIG. 2, the handle arrangement is operative with a door 14 of a vehicle especially for closing the trunk of the vehicle. The handle arrangement has a handle recess 11 in the door 14, a pivoted part 10 which pivots manually, a spring 12 for supplying a spring force in the closing direction of the pivoted part, and the electrical switching element 8 and the sensor 9 in order to detect the position of the pivoted part 10. The handle recess 11 is concealed when the pivoted part 10 is in the closed position and accessible when the pivot part 10 is in the opened position. The handle recess 11 protects the electrical switch element 8, arranged inside the handle recess. The spring 12 provides a force which biases the pivoted part 10 in the closed position, thereby requiring deliberate effort to open the pivoted part 10 to reach the electric switch element 8. However, this is only an exemplary embodiment, and modified handle arrangements are also possible without departing from the scope of the invention. In particular, an adaptation of the handle arrangement with regard to the movable body part (door, trunk lid, tailgate or the like) and of the construction space available therein is possible.

LIST OF DESIGNATIONS

1 Locking device
2 Rotary catch
3 Locking bolt
4 Pawl
5 Actuator
6 Control device
7 Vehicle battery
8 Electric switching element
9 Sensor

I claim:

1. A handle arrangement mounted to a door of a vehicle, in which door there is a handle recess, the handle arrangement comprising a pivoted part being pivotable in a region of the handle recess upon installation of the handle arrangement to the vehicle, an actuating element which is arranged in the handle recess and which is covered by the pivoted part upon movement of the pivoted part to a closed position to inhibit inadvertent manual actuation upon installation of the handle arrangement to the vehicle, and which actuating element becomes accessible by a pivoting of the pivoted part against a spring force to an open position, a sensor on the pivoted part to detect at least a position of the pivoted part, in which case the actuating element is only activatable upon a pivoting of the pivoted part against the spring force, wherein said actuating element after activation and upon manual actuation actuates a locking device of the vehicle; and wherein the actuating element is a pushbutton electric switching element.

2. A handle arrangement as claimed in claim 1, wherein a control unit is provided to control the activation of the actuating element via at least the position detected by the sensor.

3. A handle arrangement as claimed in claim 1, wherein the handle arrangement is operative with a trunk door.

4. A handle arrangement mounted to a door of a vehicle, in which door there is a handle recess, the handle arrangement comprising a pivoted part being pivotable in a region of the handle recess upon installation of the handle arrangement to the vehicle, an actuating element which is arranged in the handle recess and which is covered by the pivoted part upon movement of the pivoted part to a closed position to inhibit inadvertent manual Actuation upon installation of the handle arrangement to the vehicle, and which actuating element becomes accessible by a pivoting of the pivoted part against a spring force to an open position, a sensor on the pivoted part to detect at least a position of the pivoted part, in which case the actuating element is only activatable upon a pivoting of the pivoted part against the spring force, wherein said actuating element after activation and upon manual actuation actuates a locking device of the vehicle; and wherein the actuating element is an electric switching element which lies in an electric circuit with a power supply unit and an actuator, the actuator being provided for the actuation of a lock element of the locking device.

5. A handle arrangement mounted to a door of a vehicle in which door there is a handle recess, the handle arrangement comprising a sensor, a circuit and a control device, a pivoted part pivotable in a vicinity of the handle recess upon installation of the handle arrangement to the vehicle, an actuating element arranged in the handle recess upon installation of the handle arrangement to the vehicle, and wherein the actuating element is covered by said pivoted part upon movement of the pivoted part to a closed position such that the pivoted part inhibits inadvertent manual actuation of said actuating element, said actuating element being accessible only after pivoting of the pivoted part against a spring force to an open position, said sensor and said handle recess providing a constructional unit upon installation of the handle arrangement to the vehicle, said sensor being mounted on the constructional unit to detect at least a position of the pivoted part, wherein the actuating element is enabled to unlock the doors of the vehicle by operation of the circuit and the control device only after a pivoting of the pivoted part into the open position; and wherein the actuating element is a pushbutton electric switching element.

6. A handle arrangement mounted to a door of a vehicle in which door there is a handle recess, the handle arrangement comprising a sensor, a circuit and a control device, a pivoted part pivotable in a vicinity of the handle recess upon installation of the handle arrangement to the vehicle, an actuating element arranged in the handle recess upon installation of the handle arrangement to the vehicle, and wherein the actuating element is covered by said pivoted part upon movement of the pivoted part to a closed position such that the pivoted part inhibits inadvertent manual actuation of said actuating element, said actuating element being accessible only after pivoting of the pivoted part against a spring force to an open position, said sensor and said handle recess providing a constructional unit upon installation of the handle arrangement to the vehicle, said sensor being mounted on the constructional unit to detect at least a position of the pivoted part, wherein the actuating element is enabled to unlock the doors of the vehicle by operation of the circuit and the control device only after a pivoting of the pivoted part into the open position; and wherein the actuating element is an electric switching element which lies in an electric circuit with a power supply unit and an actuator, the actuator being provided for the actuation of a lock element of the locking device.

* * * * *